US005579656A

United States Patent [19]

Shin

[11] Patent Number: 5,579,656

[45] Date of Patent: Dec. 3, 1996

[54] DETERGENT DISSOLUTION APPARATUS OF WASHING MACHINE

[75] Inventor: Jeong S. Shin, Suwon, Rep. of Korea

[73] Assignee: Samsung Electronics Co., Ltd., Suwon, Rep. of Korea

[21] Appl. No.: 399,148

[22] Filed: Mar. 6, 1995

[30] Foreign Application Priority Data

Sep. 1, 1994 [KR] Rep. of Korea ..... 94-22042
Sep. 22, 1994 [KR] Rep. of Korea ..... 94-23896

[51] Int. Cl.[6] ..... D06F 39/02

[52] U.S. Cl. ..... 68/17 R; 137/268; 422/266; 422/274

[58] Field of Search ..... 68/17 R, 17 A; 134/93; 422/263, 266, 267, 274, 275; 137/268; 4/225.1, 226.1, 231, 232; 206/219; 239/310, 432

[56] References Cited

U.S. PATENT DOCUMENTS 1,681,308 8/1928 Parker ..... 137/268 X
1,681,362 8/1928 Pike ..... 137/268 X
4,154,258 5/1979 Duda et al. ..... 137/268
4,407,779 10/1983 Thompson ..... 422/274 X
5,473,914 12/1995 Pyo et al. ..... 68/17 R

FOREIGN PATENT DOCUMENTS 0005989 12/1979 European Pat. Off. ..... 68/17 R
2632984 12/1989 France ..... 68/17 R
2920000 12/1979 Germany ..... 68/17 R

*Primary Examiner*—Philip R. Coe
*Attorney, Agent, or Firm*—Burns, Doane, Swecker & Mathis, L.L.P.

[57] ABSTRACT

A clothes washing machine includes a water supply nozzle and a detergent dissolving apparatus disposed beneath the nozzle. The dissolving apparatus includes a receptacle having a semi-spherical recess for containing detergent, and a cover overlying the receptacle. The cover includes a filter having a central hole aligned with the nozzle to enable a water stream from the nozzle to enter the recess. The recess includes a convex projection extending upwardly from a center of the bottom of the recess, and radial ribs extending upwardly from the projection.

20 Claims, 3 Drawing Sheets

DETERGENT DISSOLUTION APPARATUS OF WASHING MACHINE

BACKGROUND OF THE INVENTION

This invention relates to a powered detergent dissolution apparatus of a washing machine.

In general, the washing process of a washing machine has to employ a detergent to effectively wash clothes etc. some detergents are in powder form. Even after rinsing the powder detergent out of the clothes several times (about 4 times), some constituent of the detergent remains in the clothes. To avoid this, the detergent should be dissolved in advance with water outside of the washing machine and the dissolved detergent be poured into the tub of a washing machine. This calls for a mechanical detergent dissolving apparatus which prevents the power detergent from remaining on clothes.

Meanwhile, for the detergent to be dissolved, the attractive force between the solute (detergent) molecules must be less than the attractive force between the solute molecule and solvent (water) molecules. That is, the detergent is dissolved when the force attracting the detergent molecules to the water molecules is greater than the force drawing the detergent molecules together. When the adherence of the solute particles, i.e. a lump of detergent, becomes separated into solute particles, a contact area between the solute molecules and the solvent molecules is increased so as to achieve rapid dissolution.

The steps in a course of dissolution comprise a first step in which water permeates into a body of detergent and every particle is separated, a second step in which detergent particles are mixed with water so as to be broken into molecules, and a third step in which detergent molecules are dissolved with an ionization. The factors accelerating the separation and the dissolution of the particles are for example, the nature of the components of the detergent, or temperature of water, etc. The critical factor is physical flow energy applied externally. The stream force of the water stream applied against the detergent is doubled to increase energy. The best way to double the stream force is the nozzle force increase method utilizing a faster stream speed or a reduction in the crosssection of the nozzle.

A conventional detergent dissolution apparatus of a washing machine, using the force of the stream jetted from a nozzle, is shown in FIG. 5. A water supplying valve 110 having a nozzle 111 and an air intaking opening 112 is connected to the body 120 of the apparatus. In the interior of the body, there is provided an interior case 130. A filter 140 which is formed as a funnel or a truncated cone is placed in the interior case 130. The stream speed is increased as the crosssection of the outlet of the nozzle 111 is reduced, while further the speed is also increased as air is intaken through the air passage 112. This is due to the pressure decrease of the circumference of the nozzle outlet 112. The faster stream strikes against the detergent contained in the filter, and the stream passing through the filter vortex, as shown by arrow "D", in the interior case 130 for despersion of the detergent. The apparatus further provides an auxiliary filter 150 spaced from the outlet of the nozzle 111, thereby preventing the detergent from flowing back into the valve 110.

It can occur that a mass a of detergent particles is separated by the force of the stream and becomes disposed at the upper edge of the filter 40. The detergent particles are to be dissolved during the circulation of the particles in the interior case. When the stream pressure is in the lower (weaker) state (about 0.8 kgf/cm$^2$), the force acting against the mass A is too weak to dislodge the mass. Thus, and the mass of detergent still remains at the upper edge of the filter. That force can be analyzed as follows.

From the impulse and the momentum equation, the fluid force F of the outlet of the nozzle is generally given by $$F=e \times Q \times v \tag{1}$$

where e=density of fluid, kgf/cm$^3$

Q=volume of fluid, 1/min

V=speed, m/s

Since the speed V of the fluid having a predetermined volume Q is decreased after leaving the nozzle, the force $F'_2$ acting against the mass A given by $$F'_2=\{eQV-(H_{1'}+H_{2'}+H_{5'}+L')\}\tan\beta \tag{2}$$

where $H_{1'}$=resistance of auxiliary filter, kgf $H_{2'}$=resistance of detergent height, kgf $H_{5'}$=resistance of detergent filter, kgf L'=weaken force according to loss of fluid volume, kgf β=reflect degree of fluid stream, deg.

Wherein, $H_{2'}$ can be disregarded because it diminishes quickly during the dissolution of the detergent. Comparing this equation with equation (1), the initial force is weakened as a function of the resistance of the auxiliary filter $H_{1'}$, the resistance of bottom of filter $H_{5'}$, the loss of fluid volume L', and the value eQV tan β.

Moreover, the detergent particles which overflow from the upper periphery of the filter, with the water stream "B", will in the initial stage of the water supply, accumulate in the lower corner portion C. Consequently, the streamline water current D can not contact that accumulated detergent so it remains, which causes other problems. For example, remaining detergent continues to dissolve until the last stage of the water supply cycle, and makes bubbles during the rinsing cycle. The bubbles flow into the tub or flow up from the gap between the body and the opening.

Furthermore, since the detergent particles are undissolved at the initial stage or the main water supply stage when the stream has high pressure, those particles fully occupy the filter, reduce the outgoing water volume to a value less than that of the incoming water through the nozzle. Also, a lump of detergent particles entrained in the water is are reverse-flowed out from the top of the detergent container (F). To solve the problem, the gap G, through which the detergent flows out, needs to be narrower. The more the gap is narrowed, the more the detergent dissolved in the water flows backward through the air inlet 112 of the water supply valve (in the absence of filter 150). This phenomenon continues for an extended period, because the reduced-pressure water stream cannot quickly dissolve the detergent. The problem becomes more serious as the substance (soup) in the filter becomes more sticky. To solve this problem, the filter 150 is installed at the outlet of the water supply valve, but this too becomes a factor in reducing the nozzle jetting force.

SUMMARY OF THE INVENTION

An object of the present invention is to provide a detergent dissolution apparatus for a washing machine which solves the above problems.

Another object of the present invention is to provide a detergent dissolution apparatus for a washing machine in which the nozzle jetting force is effectively applied onto the detergent without an appreciable loss so as to reduce the remaining volume of the detergent. The intermediate resistance of the flow passage is also eliminated so as to increase the vortex force.

Another object of the present invention is to provide a detergent dissolution apparatus for a washing machine in which a filter covers the upper portion of the detergent containing receptacle which prevents the undissolved detergent particles from flowing out, thereby promoting the dissolubility of the detergent.

According to the present invention, the detergent dissolution apparatus for a washing machine comprises a lower detergent hemispheric receptacle having detergent therein, the center of the bottom of the receptacle being convexly formed, an inner wall thereof having a plurality of radial extending ribs. The detergent dissolution apparatus for a washing machine further comprises an upper domed cover carry a filter and having a supply opening.

The upper detergent receptacle and the upper cover are hingedly connected and utilize a coil spring. Flanges provided on the receptacle and the cover have a plurality of openings used as passages for the detergent-dissolved water which has passed through the filter.

Further, a junction of warm and cool water flow converges in the supply opening of the upper cover.

Furthermore, a filter shaped in a reverse-truncated cone is placed on the lower detergent receptacle.

DESCRIPTION OF THE PREFERRED EMBODIMENTS

Figure 1:
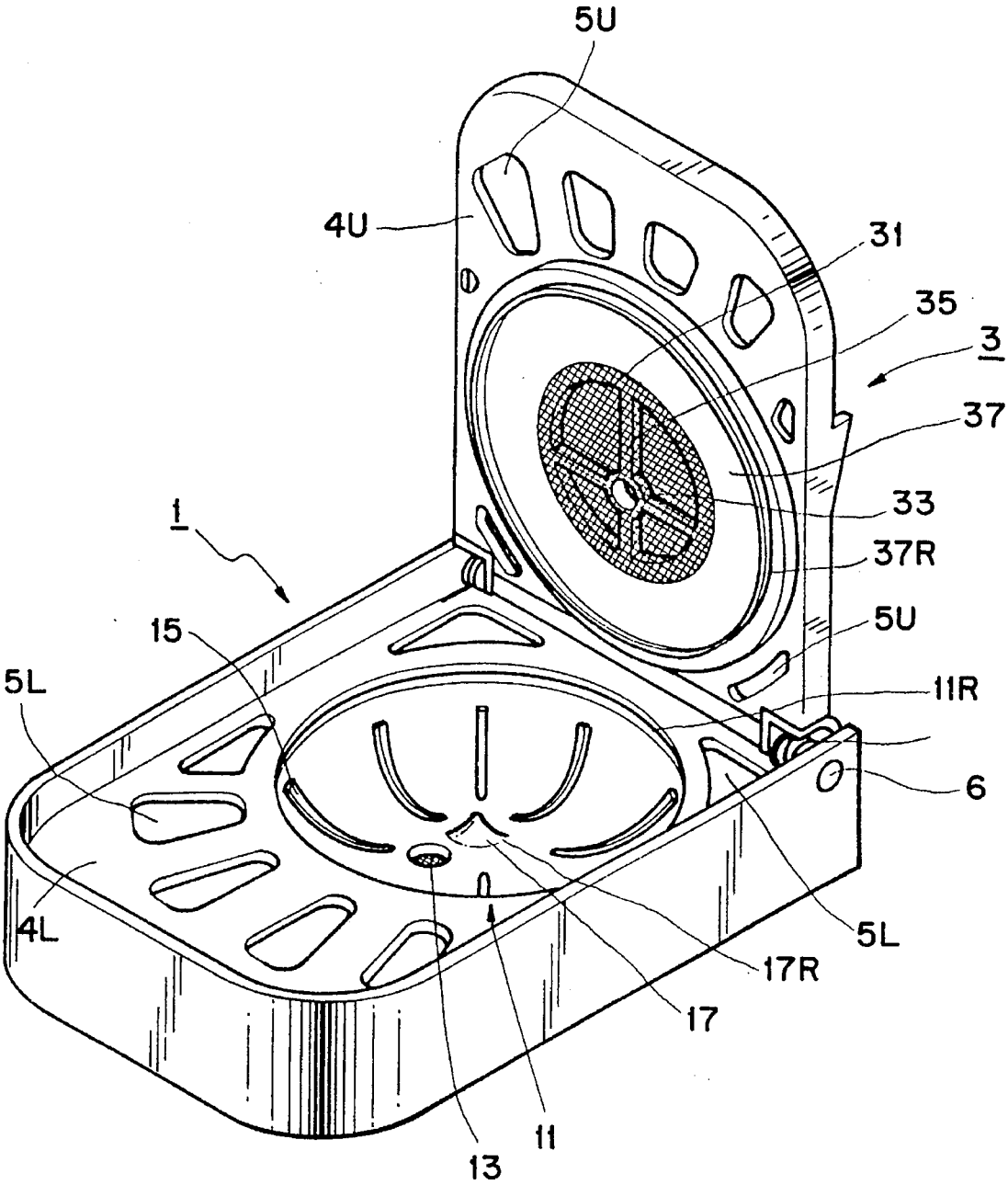
FIG. 1 is a perspective view of a detergent dissolution apparatus for a washing machine according to the invention.
Figure 2:
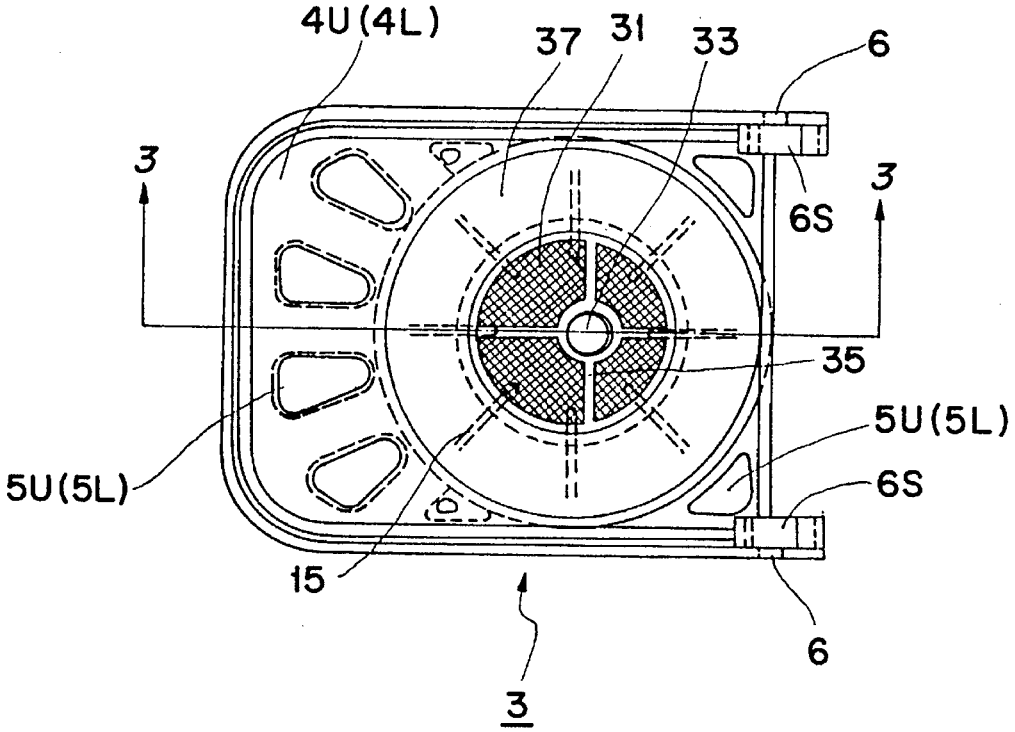
FIG. 2 is a top plan view of FIG. 1.
Figure 3:
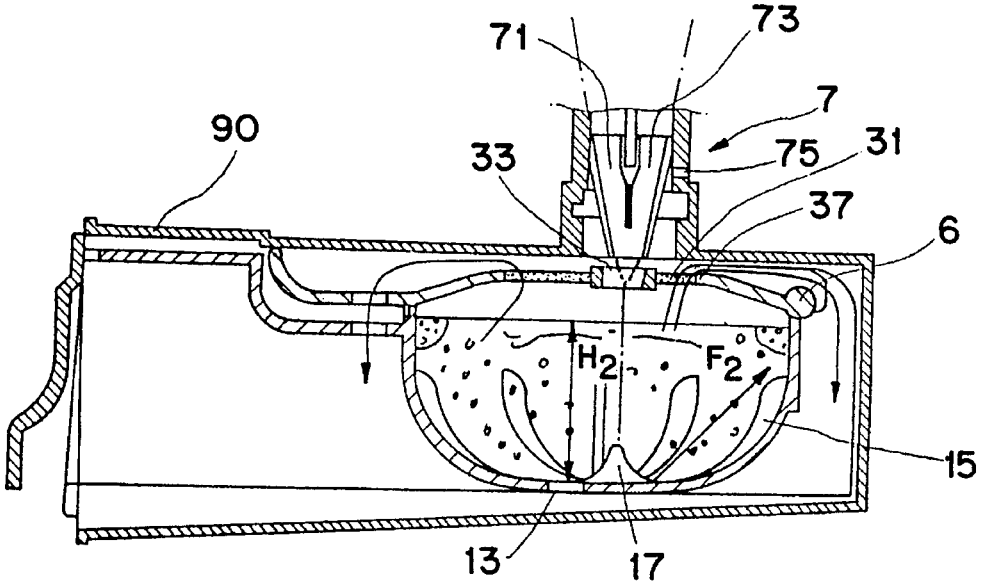
FIG. 3 is a vertical sectional view taken along line 3—3 of FIG. 2 with the detergent dissolution apparatus placed into a housing.

In FIGS. 1 to 3, a detergent dissolution apparatus comprises a lower detergent receptacle 1 having a detergent containing member 11, and an upper cover 3 placed over the lower detergent receptacle 1. The upper cover 3 carries a filter 31 in the center portion of the cover 3. The filter 31 has a supply opening 33 for the passing of the water stream from the water supply member 7. Around the outer periphery of the filter 31 a domed guide plate 37 is provided for smoothly circulating the detergent housed in the containing member 11. The dome shape ensures that a space is created between the upper portion of detergent in the containing member 11 and the lower surface of the guide plate 37.

A rim 37R of the guide plate 37 is received in the rim 11R of the containing member 11, which will be explained later. Further, to stiffen the filter 31 a plurality of ribs 35 extend outward-radially from the supply opening 33. Further, a plurality of openings 5U are provided at the flange 4U formed on the outer-ring of the guide plate 37. Detergent-dissolved water, (i.e., water which contains dissolved detergent) passing through the filter 31, flows through the openings 5U, 5L which will be explained later, to the tub (not shown).

The lower detergent receptacle 1 comprises a recessed detergent containing member 11, shaped as a hemisphere, which houses detergent therein, and a flange 4L formed around the circumference of the containing member 11. The containing member 11 further comprises a convex member 17 co-axially aligned with the supply opening 33.

At the lowermost point, i.e., at the base of the rim of the convex member 17, of the containing member 11 a residual discharge opening 13 is disposed. The detergent-dissolved water remaining in the containing member 11 flows through the discharge opening 13 to a tub in the washing machine. A filter is provided at the discharge opening 13 for preventing undissolved particles from flowing into the tub. On the inner side wall of the containing member 11 radial guide ribs 15 extend between the upper base rim 11R of the containing member 11 and the rim 17R of the convex member 17. The convex member 17 and the ribs 15 help the water jetted from the supply opening to smoothly circulate in the containing member 11.

The outer-diameter of the rim 11R of the containing member 11 is slightly smaller than the inner-diameter of the rim 37R of the guide plate 37, whereby the rim 31R tightly contacts the rim 11R. Thus, undissolved detergent particles cannot flow out of the dissolution apparatus. Further, a plurality of openings 5L are provided in the flange 4L and aligned with the openings 5U of the upper cover 3. The detergent-dissolved water can smoothly flow into the tub.

At adjoining rear ends of the respective lower detergent receptacle 1 and upper cover 3 a hinge portion 6 having a coil spring 6S is provided. When in an unbiased state, i.e. the force of the coil spring 6S is not applied, the upper cover 3 is always in an upright position. The lower detergent receptacle 1 is slid into the compartment 90 until the upper cover 3 is forced closed and covers the containing member 11. On the contrary, when the receptacle 1 is pulled away from the compartment 90, the upper cover 3 is gradually distanced from the containing member 11, and eventually opens to enable detergent to be introduced into the containing member 11.

Meanwhile, when the dissolution apparatus is fully inserted into the compartment 90, the supply opening 33 of the upper cover 3 is disposed directly under the water supply member 7. The water stream jets from a warm water nozzle 71 and a cool water nozzle 73 which are provided in the water supply member 7. The two water streams are intercrossed in the supply opening 33 so as to be jetted to the containing member 11 with a constant flow speed. This prevents problems which could otherwise occur if (i) the flow speed adjacent to the innerside wall of the respective nozzles 71,73 were not equal to that of the center of the respective nozzles 71,73 due to the resistance on the inner wall of the nozzle, or (ii) if a flow stream of uneven speed were to strike the detergent in the containing member 11, causing a part of the undissolved detergent to overflow from the supply opening 33.

The detergent dissolution apparatus built as described above is operated as follows. A predetermined volume of detergent is poured into the containing member 11, and the lower receptacle 1 is pushed into the compartment 90. In the water supply cycle, water streams from their respective nozzles 71,73 are intercrossed in the supply opening 33 producing a consistent flow speed in the center or the periphery of the nozzle, and then the stream of even speed strikes the detergent. As the flow stream dissolves the detergent in the center of the containing member 11 and collides with the convex member 17, the jetting flow produces a vortex movement and moves radially upwardly along the ribs 15. The upward flow dissolves the detergent along the periphery of the containing member 11, and then the continuous upward flow moves along the under surface of the domed guide 37 of the upper cover 3. The continuous stream then flows back down to the convex member 17 upon reaching the jetting stream from the nozzle.

During the dissolution process, the force $F_2$ is applied to the a mass of detergent disposed adjacent to the upper rim of containing member 11, where the stream force applied is weaker, and is explained, deriving from previously discussed Equation 1;

$$F_2=eQVH_2 \quad (3)$$

where $H_2$=resistance of detergent height, kgf

Wherein, $H_2$ can be disregarded because it diminishes soon during the dissolution of the detergent.

Equation 3 is compared with Equation 1 which is a force created in the prior art, and it is found that the force of the present invention is much larger. Thus, the stream has a stronger jetting force.

The detergent is dissolved by the strong force stream and turns to a bubbly solution. The dissolved detergent passing through the filter 31 flows up through the upper cover 3, and the stream drops to the tub of the washing machine through the openings 5U,5L. On the other hand, the dissolved detergent, which has not yet flowed out through the filter 31 in upper cover 3, is drained into the tub through the residual discharge opening 13.

Figure 4:
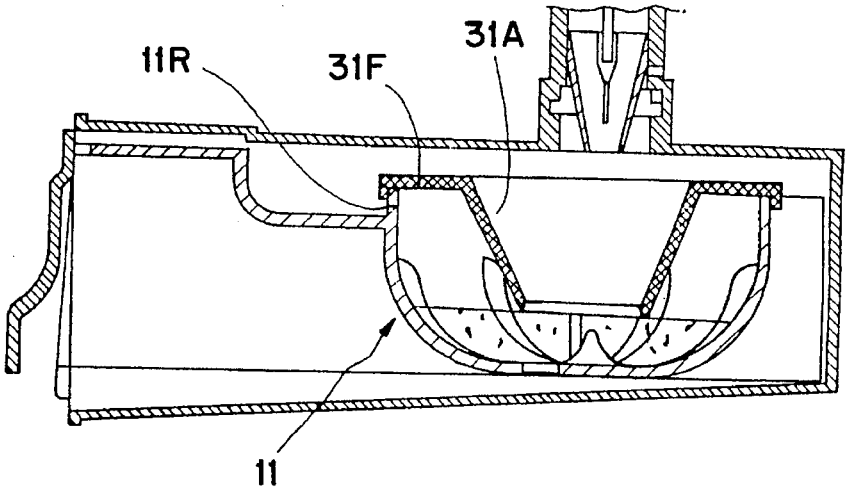
FIG. 4 is a vertical sectional view of another embodiment of a detergent dissolution apparatus for a washing machine according to the invention.
Figure 5:
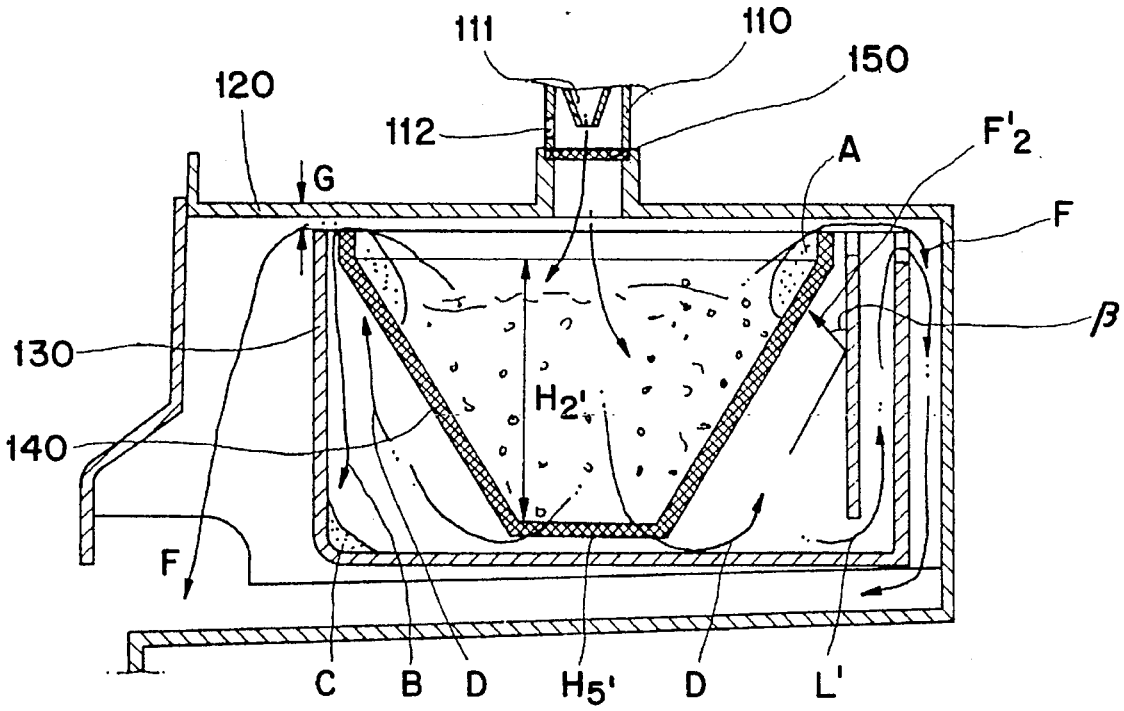
FIG. 5 (PRIOR ART)
FIG. 5 is a vertical sectional view of a detergent dissolution apparatus for a washing machine according to a prior art.

The other embodiment of the detergent dissolution apparatus for a washing machine is shown in FIG.4. The apparatus comprises a detergent containing member 11 (similar in structure to that which was earlier described and a filter 31A placed on the detergent containing member 11. The filter 31A is formed as a truncated cone, and the upper central portion of the filter 31A is aligned with the lower central portion thereof. Further, a flange 31F is radially extended around the periphery of the upper border of the filter 31A. The flange 31F is placed on the upper border 11R of the containing member 11.

According to the structure of the detergent dissolution apparatus, the detergent is struck by a water stream through the supply opening by a strong jetting force, causing the vortex force to increase so as to eliminate the intermediate resistance applied against the jetting stream. The jetting force is evenly applied to the detergent so as to decrease the amount of remaining detergent in the containing member. Further, the space, provided between the detergent and the upper cover, helps the stream to actively circulate. All of the detergent is dissolved making bubbles only in the water supplying cycle (i.e., not in the rinsing cycle). Furthermore, the rate C of dissolution is increased by the strong water stream, and thus the volume of the containing member can be reduced. This prevents the environmental pollution caused by the excessive usage of detergent. More, since the upper cover (FIG. 1–3) or the filter (FIG. 4) is provided above the detergent, it prevents the undissolved particles of detergent from flowing out by itself.

What is claimed is:

1. A detergent dissolving apparatus for a washing machine to dissolve detergent particles in wash water supplied from a nozzle, the apparatus comprising:

a lower detergent receptacle for containing the detergent, and an upper cover overlying an upper portion of said receptacle and including a filter for conducting from the receptacle a flow of water containing dissolved detergent, said cover being openable with respect to said receptacle and biased to an open state, said cover being forced closed in response to being inserted into a washing machine.

2. The apparatus according to claim 1, wherein said receptacle includes a detergent-containing recess of concave shape.

3. The apparatus according to claim 2, wherein the recess is of semi-spherical shape.

4. The apparatus according to claim 3, wherein said semi-spherical recess includes a convex projection extending upwardly from a center of a bottom of said recess.

5. The apparatus according to claim 4, wherein said recess includes a plurality of ribs extending radially upwardly from said projection.

6. The apparatus according to claim 5, wherein said bottom of said recess includes a filtered discharge opening.

7. The apparatus according to claim 3, wherein said recess includes a plurality of ribs extending upwardly from a center of a bottom of said recess.

8. The apparatus according to claim 3, wherein said bottom of said recess includes a filtered outlet.

9. The apparatus according to claim 1, wherein said filter includes a water conducting passage aligned with the nozzle, for admitting water into said receptacle.

10. The apparatus according to claim 9, wherein said cover is dome-shaped.

11. The apparatus according to claim 1, wherein said cover is hinged to said receptacle and is biased open by a coil spring disposed at said hinge.

12. The apparatus according to claim 1, wherein said receptacle includes a detergent-receiving recess, and a first horizontal flange encompassing an upper periphery of said recess, said cover including a second horizontal flange overlying said first flange, said first and second flanges including through-holes for conducting a flow of detergent-containing water traveling from said receptacle through said filter.

13. The apparatus according to claim 1, wherein said cover constitutes a filter.

14. The apparatus according to claim 13, wherein said cover includes a center portion configured as a truncated cone and projecting downwardly into said receptacle.

15. clothes washing machine comprising:

a compartment including a water supply nozzle for conducting a stream of wash water;

a receptacle disposed in said compartment and including a semi-spherical recess, a convex projection disposed at a center of a bottom of said recess, and radial ribs extending generally radially from said projection; and a cover overlying said receptacle and including a filter having an inlet hole aligned with said water supply nozzle, said filter conducting a flow of dissolved detergent-containing water from said recess.

16. The clothes washer according to claim 15, wherein said water supply nozzle includes means for mixing hot and cold water.

17. The clothes washer according to claim 15, wherein said receptacle includes a first horizontal flange encompassing at least a portion of an upper periphery of said recess, said cover including a second horizontal flange overlying said first flange, said first and second flanges including through-holes for conducting detergent-containing water from said filter.

18. The clothes washer according to claim 15, wherein said bottom of said recess includes a filtered outlet.

19. The clothes washer according to claim 15, wherein the cover constitutes a filter.

20. A detergent dissolving apparatus for a washing machine to dissolve detergent particles in wash water supplied from a nozzle, the apparatus comprising:

a lower detergent receptacle for containing the detergent, said receptacle including a detergent-containing recess of semi-spherical concave shape, said recess including a convex projection extending upwardly from a center of a bottom of said recess, and an upper cover overlying an upper portion of said receptacle and including a filter for conducting from the receptacle a flow of water containing dissolved detergent.

* * * * *